United States Patent [19]

Krulich

[11] Patent Number: 4,892,333

[45] Date of Patent: Jan. 9, 1990

[54] WINDOW POCKET INSERTION DEVICE AND METHOD OF USE THEREFOR

[76] Inventor: Ronald F. Krulich, 8945 Mystic La., Warren, Mich. 48093

[21] Appl. No.: 58,262

[22] Filed: Jun. 4, 1987

[51] Int. Cl.[4] ..... B42D 3/00; B42F 13/00; B25B 9/00; A41H 43/00

[52] U.S. Cl. ..... 281/15.1; 223/50; 281/29; 281/31; 281/36; 294/99.2; 402/3; 402/73; 402/80 R

[58] Field of Search ..... 402/3, 73, 80 R; 281/42, 45, 48, 15.1, 29, 31, 36; 223/50; 156/65, 70; 81/43, 302, 3.47, 3.48; 493/93; 384/28; 226/6; 431/180; 29/200; 128/330; 294/99.2; 24/150 B, 150 FP, 543, 568

[56] References Cited

U.S. PATENT DOCUMENTS

| | | | |
|---|---|---|---|
| 231,349 | 8/1880 | Morton | 281/42 X |
| 1,287,329 | 12/1918 | Jennings . | |
| 1,677,277 | 7/1928 | Feberbush et al. | 402/3 |
| 1,751,181 | 3/1930 | Williams | 294/99.2 |
| 2,207,930 | 7/1940 | Miller | 294/99.2 |
| 2,412,255 | 10/1944 | Ferguson . | |
| 2,509,841 | 5/1950 | Rose | 402/3 |
| 2,601,037 | 6/1952 | Liebowitz | 223/50 |
| 2,636,500 | 5/1950 | Schwartz . | |
| 3,335,508 | 8/1967 | Hummel | 402/3 |
| 3,496,807 | 2/1970 | Jones et al. . | |
| 3,971,270 | 7/1976 | Wallace . | |
| 4,249,434 | 2/1981 | Doiron . | |
| 4,681,472 | 7/1987 | Ruble | 402/3 |

*Primary Examiner*—Paul A. Bell
*Assistant Examiner*—Paul M. Heyrana, Sr.
*Attorney, Agent, or Firm*—Peter D. Keefe

[57] ABSTRACT

Provided is an insertion device for paper sheet materials into window pockets. The invention is composed of two elongated flat prongs composed of a stiff but flexible material that are joined at one end to form a handle. Paper sheet material is placed between the elongated flat prongs which act as a shield therefor during insertion of the invention into a window pocket. A finger placed on a protruding edge corner of the paper sheet allows withdrawal of the invention from the window pocket without removing the paper sheet. The invention may be used for extraction of the paper sheet as well.

2 Claims, 2 Drawing Sheets

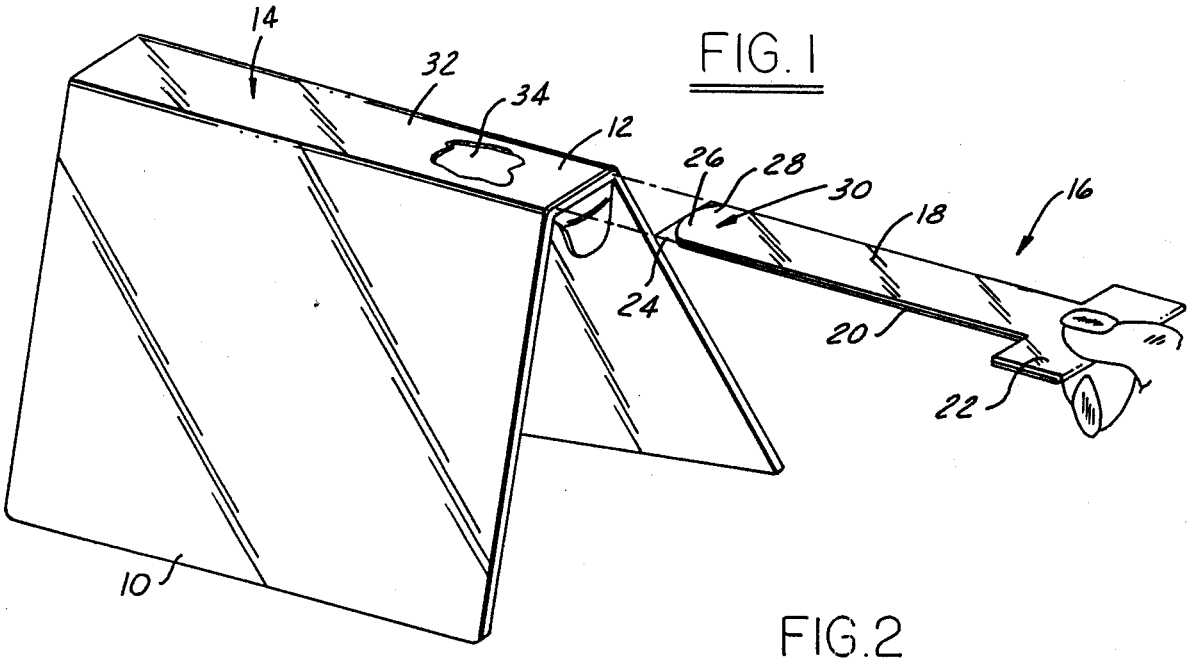
FIG. 1
FIG. 2
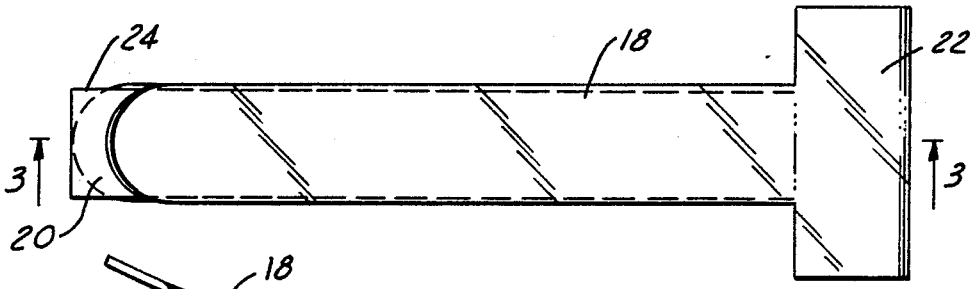
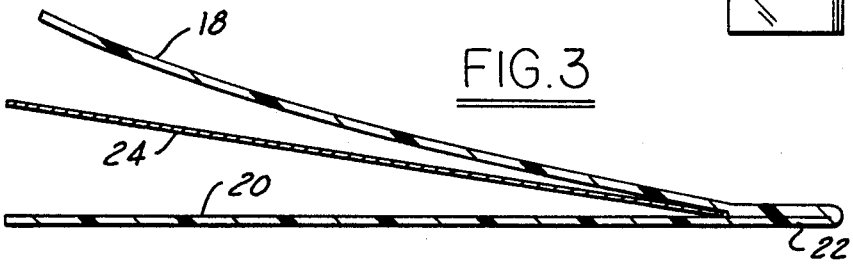
FIG. 3
FIG. 4
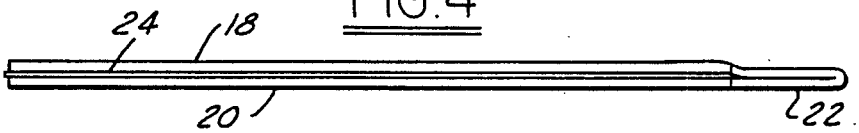
FIG. 5
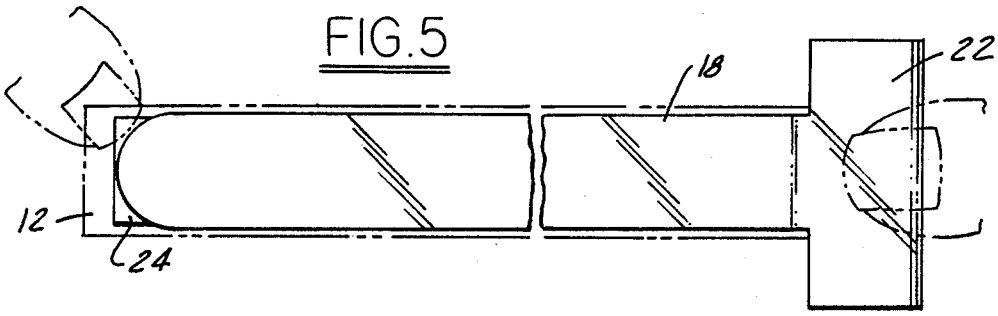

WINDOW POCKET INSERTION DEVICE AND METHOD OF USE THEREFOR

BACKGROUND OF THE INVENTION

This invention relates to a device for inserting papers and the like into a window pocket of the kind used for retaining paper sheet materials and the like.

The high cost of printed binders has made the use of binders having clear window pockets a viable alternative thereto, in which a printed paper is inserted into the window pocket. This gives an attractive appearance and permits customization of binders for particular uses. Typically, window pockets are made of clear vinyl material which is sealed tightly to the binder along the vertical edges and bottom, with the binder having two such pockets, one on the front cover and one on the spine.

The problem that arises is the difficulty of inserting the paper sheet into the window pocket, particularly the spine window pocket. This is because the clear plastic overlay of the window pocket is stretched tightly across the binder surface, thereby preventing the paper sheet from easily entering between the surfaces of the window pocket overlay and the binder and, particularly, often inhibiting the introduction of the paper sheet into the lower portions of the window pocket. Indeed, frequently much material waste due to wrinkling and tearing of the paper sheet results; additionally, lost productive time occurs because of the difficulty of causing the paper sheet to properly enter and correctly seat in the window pocket. This problem is compounded when a large number of binders must be serviced in a short period of time as often happens in commercial settings where these binders are used for a wide range of uses.

Accordingly, there exists a need in the prior art to provide a device and method that will allow easy, quick and effective insertion and seating of paper sheet into a window pocket.

SUMMARY OF THE INVENTION

Provided is a two piece, flexible inserter device, and method for using same, for introducing and seating paper sheet material into binder window pockets.

The inserter is composed of two elongated flat prongs of a length greater than, and width less than, that of the pocket window dimensions. Each of the elongated flat prongs are made of a stiff but flexible material, such as sheet plastic, clear sheet plastic being preferred. A handle portion is provided where the elongated flat prongs meet. Rounded corners are provided at the end of each of the elongated flat prongs.

According to the method of the invention, a paper sheet is inserted between the elongated flat prongs so that the paper sheet protrudes slightly at the rounded corners of the elongated flat prongs. The elongated flat prongs are then inserted into the window pocket. When a desired seating location and orientation is achieved, finger pressure is applied on the protruding paper sheet which allows the paper sheet to remain in the window pocket as the elongated flat prongs are withdrawn by pulling on the handle with the free hand.

Paper sheet may also be withdrawn from a window pocket by inserting the elongated flat prongs into the window pocket so that the paper sheet is between the elongated flat prongs. The friction between the surfaces of the elongated flat prongs and the paper sheet will then allow the easy removal of the paper sheet from the window pocket by simple extraction of the elongated flat prongs using a pulling action on the handle.

Accordingly, it is an object of the present invention to provide a device which allows simple and easy insertion of paper sheet into a window pocket.

It is an additional object of the invention to provide a method for inserting paper sheet into a window pocket whereby efficiency is maximized and waste is eliminated.

These and additional objects, features, advantages and benefits of the invention will become apparent from the following description of the preferred embodiment.

BRIEF DESCRIPTION OF THE DRAWINGS

FIG. 1 is a perspective view showing the invention being used to insert a paper sheet into a binder spine window pocket.

FIG. 2 is a plan view of the invention showing a paper sheet inserted between the elongated flat prongs, with the uppermost prong bent upwards.

FIG. 3 is a side view of the invention along line 3—3 in FIG. 2.

FIG. 4 is a side view of the invention as in FIG. 3, but with the uppermost elongated flat prong straight.

FIG. 5 is a plan view of the invention showing finger positions used in carrying out the method of the invention.

DETAILED DESCRIPTION OF THE PREFERRED EMBODIMENT

Figure 6:
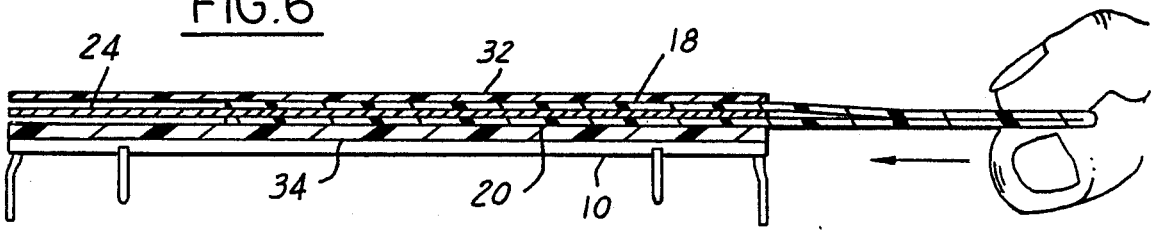
FIG. 6 is a part sectional side view showing the invention being inserted into a binder spine window pocket along the direction of the arrow shown in order to remove a sheet.
Figure 7:
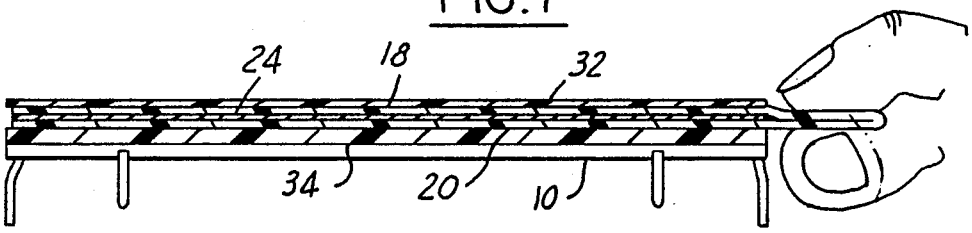
FIG. 7 is a part sectional side view showing the invention inserted into the binder window pocket of FIG. 6.
Figure 8:
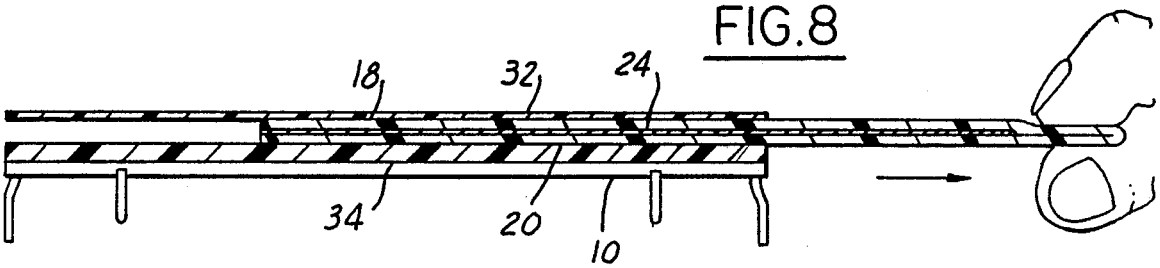
FIG. 8 is a part sectional side view showing the invention removing the sheet from the binder window pocket of FIG. 6 along the direction of the arrow shown.

Referring now to FIG. 1, a binder 10 is shown having a window pocket 12 on its spine 14. The invention 16 is shown in an orientation relative to the window pocket for inserting thereinto. As may be seen from the figure, the invention is composed of two elongated flat prongs 18 and 20 which connect together at a handle 22. A paper sheet 24 is placed between the elongated flat prongs, and protrudes at the corners 26 and 28 of the elongated flat prongs. The user is shown holding the invention 16 by grasping the handle. The forward end 30 of the invention is then placed between the window pocket overlay 32 and the binder surface 34. The elongated flat prongs are then thrust into the window pocket in order to locate and orientate the paper sheet as desired within the window pocket.

Each of the elongated flat prongs 18 and 20 is made of a thin and stiff but flexible material, such as plastic. Preferably the elongated flat prongs are clear in order to facilitate orientation of the paper stock within the window pocket. The elongated flat prongs are joined by conventional means, such as by gluing or by sonic or heat welding to form a handle 22. The handle may be considerably wider than the elongated flat prongs, as shown, to facilitate user handling of the invention when it is in use. Each of the elongated flat prongs is dimensioned to fit within the window pocket of a binder and be as nearly coextensive with the width thereof as is possible and still permit insertion therein without need of forcing. Both elongated flat prongs 18 and 20 are of substantially identical length, which is at least equal to the length of the window pocket 12. The attachment of the elongated flat prongs to form the handle 22 is such as to allow flexibility without cracking or breaking when the elongated flat prongs are separated from each other. The ends 30 of the elongated flat prongs are rounded at the corners 26 and 28. The rounding of the corners is to allow the paper sheet which is inserted between the elongated flat prongs to be fully covered at the center but protrude 24 at the corners 26 and 28.

FIGS. 2 through 5 show the invention in greater detail. FIG. 3 shows how a paper sheet 24 may be inserted between thet elongated flat prongs 18 and 20, in this case by bending upwardly one of the elongatd flat prongs 18. FIG. 2 shows a plan view of the invention with one of the elongated prongs 18 bent upwards, as in FIG. 3. FIG. 4 shows the paper sheet 24 now inserted into the invention and ready for insertion into the window pocket 12. FIG. 5 shows the invention 16 inserted into the window pocket 12, where the paper sheet 24 has been located and orientated into the desired position in the window pocket.

According to the method of the present invention, a paper sheet may be inserted inside a window pocket by the following steps:

Inserting a paper sheet between two elongated flat prongs;

inserting the elongated flat prongs with a paper sheet therebetween into the window pocket;

adjusting the elongated flat prongs until the paper sheet is located and oriented in the window pocket as desired;

placing a finger on a protruding edge of the paper sheet at one of the rounded ends of the elongated flat prongs so as to hold the paper sheet in place by friction; and pulling outwardly on said elongated flat prongs so as to remove the elongated flat prongs from the window pocket without moving the paper sheet.

According to the method of the present invention, a paper sheet may be removed from a window pocket by the following steps:

Inserting two elongated flat prongs into the window pocket, one on either side of the paper sheet therein; and pulling on the elongated flat prongs so as to remove them with the paper therebetween from the window pocket.

To those skilled in the art to which this invention appertains, it is clear that the invention herein described according to the preferred embodiment is applicable to an array of employments wherever flat sheets must be inserted into a flat pocket. Accordingly, this invention is not intended to be limited to merely binder window pockets or paper sheet material inserts, which is here recited only as a preferred embodiment of the invention, but rather is intended to be limited only by the scope of the appended claims.

What is claimed is:

1. A device for inserting and removing sheet material with respect to a pocket, said pocket being defined by an outer overlay surface and an inner surface, said device comprising:

pair of prongs, each prong of said pair of prongs having a mutually similar length, width and thickness, each said prong being oriented in mutual parallel relationship, each said prong having a thin thickness as compared with said width, said length and said width of each said prong forming a substantially rectangular shape which defines a first face and an opposite second face, each first face of said pair of prongs being in mutual adjacency, each of said prongs further being flexibly joined at one end so as to permit the sheet material to be placed between each said first face of said pair of prongs, each said prong of said pair of prongs being dimensioned so that said pair of prongs and the sheet material may be both inserted into the pocket and removed from the pocket with only an extreme end portion of the sheet material contacting the pocket, said pair of prongs being structured to guide the sheet material into a seating position in the pocket when said pair of prongs is moved inward relative to the pocket, said pair of prongs being structured to frictionally interact with the sheet material so as to remove the sheet material from said seating position in the pocket when said pair of prongs is moved outward relative to the pocket except when the outer overlay surface of the pocket is pressed against said extreme end portion of the sheet material thereby trapping the sheet material between the outer overlay surface of the pocket and the inner surface of the pocket.

2. The insertion device of claim 1, wherein each of said prongs is made of a flexible, clear plastic material so that said sheet material may be viewable when said sheet material is placed between each said first face of said pair of prongs.

* * * * *